United States Patent [19]

Schippers et al.

[11] 4,325,517

[45] Apr. 20, 1982

[54] METHOD AND APPARATUS FOR WINDING TEXTILE YARNS

[75] Inventors: Heinz Schippers; Gerhard Martens, both of Remscheid; Karl-Werner Frolich, Wuppertal-Langerfeld, all of Fed. Rep. of Germany

[73] Assignee: Barmag Barmer Maschinenfabrik, Remscheid, Fed. Rep. of Germany

[21] Appl. No.: 156,568

[22] Filed: Jun. 5, 1980

[30] Foreign Application Priority Data

Sep. 18, 1979 [DE] Fed. Rep. of Germany ..... 2937601

[51] Int. Cl.[3] ..... B65H 54/38

[52] U.S. Cl. ..... 242/18.1; 242/43 R; 242/43.1; 242/176

[58] Field of Search ..... 242/18.1, 43 R, 43.1, 242/18 R, 174, 175, 176, 177, 178

[56] References Cited

U.S. PATENT DOCUMENTS

| | | | |
|---|---|---|---|
| 2,285,439 | 6/1942 | Jones | 242/43 R |
| 2,296,420 | 9/1942 | Campbell | 242/177 |
| 2,763,824 | 9/1956 | Bacheler | 242/18.1 X |
| 2,848,173 | 8/1958 | Hebberling | 242/43 R |
| 3,235,191 | 2/1966 | Engelman et al. | 242/18.1 |
| 3,402,898 | 9/1968 | Mattingly | 242/18.1 X |
| 3,727,855 | 4/1973 | Richter | 242/18.1 |
| 3,971,517 | 7/1976 | Matuura et al. | 242/18 R |

FOREIGN PATENT DOCUMENTS

| | | | |
|---|---|---|---|
| 2150301 | 4/1973 | Fed. Rep. of Germany . | |
| 1916580 | 2/1974 | Fed. Rep. of Germany . | |
| 2654944 | 6/1977 | Fed. Rep. of Germany . | |
| 2855616 | 6/1980 | Fed. Rep. of Germany . | |
| 2856014 | 7/1980 | Fed. Rep. of Germany . | |
| 908794 | 10/1962 | United Kingdom | 242/18.1 |
| 1334852 | 10/1973 | United Kingdom | 242/18.1 |

*Primary Examiner*—Stanley N. Gilreath

*Attorney, Agent, or Firm*—Bell, Seltzer, Park & Gibson

[57] ABSTRACT

A method and apparatus for winding textile yarns into core-supported packages is provided in which the formation of thickened and hardened places in the yarn packages at opposite ends thereof are avoided by a recurrent series of stroke modification cycles in which the length of traverse stroke is varied aperiodically as determined by a random number sequence. Additionally, the formation of undesirable patterns in the windings of yarn forming such packages is avoided by continuously varying the speed of traverse of the yarn guide by accelerating and decelerating the traversing yarn guide between predetermined maximum and minimum speeds. The stroke modification cycles and traverse motion speed changes are coordinated in such manner that the periods of high traverse motion speed coincide with the periods of short traverse stroke length and vice versa.

27 Claims, 3 Drawing Figures

METHOD AND APPARATUS FOR WINDING TEXTILE YARNS

FIELD OF THE INVENTION

The present invention relates to the winding of textile yarns into core-supported packages and more particularly to a method and apparatus for winding textile yarns into such packages while avoiding the formation of thickened and hardened places in the yarn packages at opposite ends thereof and also while avoiding the formation of undesirable patterns in the windings of yarn forming such packages.

BACKGROUND OF THE INVENTION

In the winding of textile yarns, it is well known to guide the yarns to rotating cores while traversing the yarn guides axially of the cores to form windings of the yarns about the cores. Such winding of textile yarns frequently results in two particularly acute problems which are respectively referred to as "hard ends" and "pattern formation."

Hard and, under certain circumstances, thickened places in the yarn packages are frequently formed at opposite ends thereof corresponding to opposite ends of the traverse stroke of the yarn guides. With conventional cylindrical and, to a lesser extent, biconical yarn packages, the yarn windings at opposite ends of the yarn packages become superimposed and with increasing package diameter cause the ends of the package to be harder than the remainder of the package. Under certain circumstances, these superimposed windings also result in the end portions of the package being thicker or having a greater diameter than the remainder of the package so that a cylindrical package build-up cannot be achieved.

There have been previous attempts to overcome this problem by temporarily shortening the traverse stroke of the yarn guides for a few windings in a repetitive pattern. The amount of traverse stroke reduction has been dependent upon the denier of the yarn and reductions of up to 10 mm have occurred. While reducing the degree of thickening and of the hardness of the end portions of such yarn packages, such previous attempts have not been found to completely solve this problem. Rather it has been frequently observed that hardened places form both at the opposite ends of the package and at the places corresponding to the ends of the shortened traverse winding strokes of the yarn guides.

In addition, such previous unsuccessful attempts to solve the "hard ends" problem have not even addressed the problem of "pattern formation" which occurs when, with increasing package diameter, the windings of yarn within the body of the yarn package become superimposed over previously formed windings. The pattern formation problem and one solution thereto are discussed in the copending application, Ser. No. 104,969 of Gerhard Martens, filed Dec. 18, 1979 and entitled METHOD AND APPARATUS FOR WINDING TEXTILE YARNS which is assigned to the same assignee as is this application. While solving the "pattern formation" problem, the method and apparatus of this copending application does not solve nor even address the "hard ends" problem.

SUMMARY OF THE INVENTION

With the foregoing in mind, it is an object of the present invention to provide a method and apparatus for winding yarns in which the formation of hardened and thickened places at opposite ends of the yarn packages is prevented and yarn packages of uniform hardness and of substantially cylindrical build-up are achieved.

This object of the present invention is accomplished by providing a recurrent series of stroke modification cycles during the formation of the yarn packages and in which the length of traverse stroke is changed during one segment of each cycle and is not changed during the remainder of the cycle and by varying the amount by which the length of traverse stroke is changed from one stroke modification cycle to another. Preferably, the amount by which the length of traverse stroke is changed is varied aperiodically as determined by a random number sequence.

It is a further object of the present invention to provide a method and apparatus for winding yarns in which the formation of hardened and thickened places at opposite ends of the yarn packages is prevented and in which undesirable pattern formation is avoided. This object of the present invention is accomplished by providing a recurrent series of stroke modification and pattern breaking cycles in which stroke modification as described above is coordinated with a continuously recurrent sequence of traverse motion speed changes.

BRIEF DESCRIPTION OF THE DRAWINGS

Some of the objects of the invention having been stated, other objects will appear as the description proceeds, when taken in connection with the accompanying drawings, in which.

DETAILED DESCRIPTION OF THE INVENTION

Figure 1:
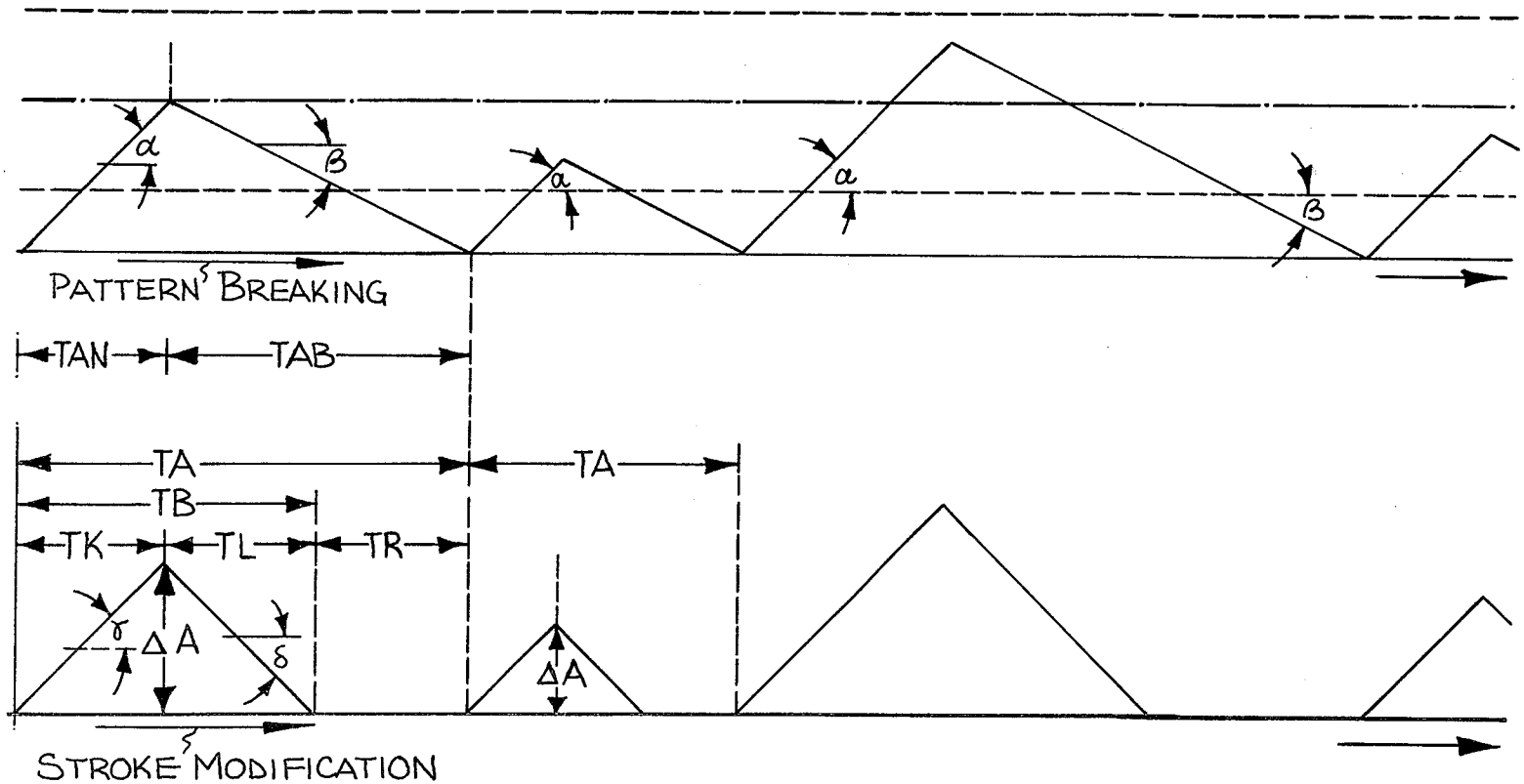
FIG. 1 is a schematic view illustrating the effects of traverse stroke modification and traverse speed change in accordance with the present invention.

As stated previously, this invention is particularly directed to apparatus for winding textile yarns (not shown) which conventionally include means for supporting and rotating suitable package cores to wind textile yarn therearound at a substantially constant rate and a traversing yarn guide for guiding the yarn onto the rotating package core. Such textile apparatus is well known to persons skilled in the textile arts.

In accordance with this invention, the winding machine or apparatus is provided with a controllable stroke reduction means, means for continuously varying the traverse motion speed of the traversing yarn guide and control means for controlling the stroke reduction means and traverse speed varying means according to a predetermined program.

The stroke reduction means may be of any suitable character, such as that shown in U.S. Pat. No. 3,730,448, and is controlled to temporarily shorten the traverse stroke in a recurrent series of stroke modification cycles. These stroke modification cycles are designated as TA in FIGS. 1 and 2. In a package formation or winding cycle, the traverse stroke is modified within a maximum differential range, the limits of which are defined by the maximum and minimum lengths of the traverse stroke of the yarn guide permissible for the particular package being formed.

In accordance with the present invention, it has been determined that it is advantageous to maintain the length of the traverse stroke at its normal, unshortened or maximum length for a certain period of time. This time period is designated as TR in FIGS. 1 and 2 of the drawings. The remainder of each stroke modification cycle constitutes a stroke shortening period (designated as TB in FIGS. 1 and 2) during which the length of the traverse stroke is modified or changed within the aforesaid maximum differential range. Preferably, each stroke shortening period or portion TB of the stroke modification cycles TA comprises a first portion TK during which the length of the traverse strokes is gradually decreased until the minimum length of stroke for that cycle is reached and a second portion TL during which the length of the traverse strokes is gradually increased until the normal or maximum length of stroke is reached.

It is also preferred in accordance with this invention that the rate at which the length of stroke is decreased during portion TK of each cycle AT is the same as the rate at which the length of stroke is increased during cycle portion TL. Accordingly, the duration for cycle portion TK is equal to the duration of cycle portion TL in each stroke modification cycle TA. Also, the duration of stroke shortening portion TB of each stroke modification cycle TA is preferably greater than the duration of the portion TR of the cycle during which the length of stroke remains unmodified. The ratio of the durations of these $$\text{portions } TR/TB = \left(\frac{TR}{TK + TL}\right)$$

of the stroke modification cycle is designated as K herein and this ratio is preferably constant for all stroke modification cycles during a package formation or winding interval T. The ratio K may be varied in accordance with the type of yarn being wound or because of other parameters, but is preferably greater than 1:4 and less than 1:2.

The amount (designated ΔA in FIGS. 1 and 2) by which the length of stroke is modified or shortened during each stroke modification cycle TA is changed or varied preferably aperiodically and preferably from one stroke modification cycle to another in accordance with the present invention. This may be achieved in any one of several different ways, such as by a random number sequence produced by a random generator with the random number sequence being put in directly or through a memory. The aperiodic changes in the amount of stroke modification ΔA may be achieved by varying the rate at which the length of stroke is changed while the duration of the period TB of each stroke modification cycle TA remains constant. Also, these aperiodic changes may be achieved by varying the duration of the period TB of each cycle TA while the rate at which the length of stroke is changed remains constant. Still further, the amount of stroke modification ΔA may be directly changed according to a preset number or random number sequence.

To avoid pattern formation in the windings or layers of windings in the yarn package, traverse speed varying means is provided for continuously varying the speed of traverse of the yarn guide within a preset range of maximum and minimum permissible traverse motion speeds. Several such traverse motion speed varying means are described in detail in the aforementioned copending U.S. application Ser. No. 104,969, filed Dec. 18, 1979. Insofar as is necessary for a more complete understanding of this invention, reference is made to this copending application and such is incorporated herein by reference.

In accordance with the present invention, such pattern breaking and the above-described stroke modification are combined in such manner that the respective problems addressed by each are solved without interference but with cooperation therebetween to the end that improved package build-up, package density or hardness, and package form or shape are obtained. Preferably, the traverse speed varying means and stroke reduction means are controlled in such a manner that the time of higher traverse motion speeds coincide with the time of short traverse strokes and vice versa.

To accomplish such control, the traverse speed varying means continuously accelerates and decelerates the speed of the traversing yarn guide and such variance in speed is controlled in such a manner that the periods of acceleration (designated TAN in FIGS. 1 and 2) occur at the same time as the periods TK during which the length of traverse stroke is being gradually decreased. Further, the periods of deceleration (designated TAB in FIGS. 1 and 2) occur at the same time as the periods TL during which the length of traverse stroke is being gradually increased and also encompass the periods TR during which the length of stroke is unchanged or remains constant.

It should be noted at this point that the terms "traverse motion speed", "traverse speed" and "speed of the traversing yarn guide" may be used in two different connotations and, as such, may have two different meanings. When used in the connotation of pattern breaking, these terms refer to the double stroke rate or number of (forth and back) strokes per minute. For example, the average traverse motion speed of a winder may be 100 double strokes/min., and this traverse motion speed may be varied for purposes of pattern breaking between 95 and 105 double strokes/min. When used in the connotation of the prevention of thickened and hardened places in the yarn packages, the speed of traverse of the yarn guide is defined differently and is usually expressed in terms of meters/min. If there is no pattern breaking system, the number of double strokes/min. will remain constant, but since the stroke length is changed, the traverse guide speed (in terms of m/min.) is necessarily changed. The two connotations of traverse guide speed or traverse motion speed are related and may be expressed in a mathematical formula as: velocity of yarn guide (M/min.)=double stroke rate (DH)×stroke length. If there is a pattern breaking system, the number of double strokes/min. will not remain constant, but will continuously change. Obviously, this will affect the velocity of the yarn guide, as does the stroke length which is changed to avoid hard package ends. As used in this patent application, "traverse motion speed", "traverse speed", or "speed of the traversing yarn guide" are used in a pattern breaking context and refer to the number of double strokes/min.

Referring now more specifically to FIG. 1, there is illustrated combined stroke modification and pattern breaking in which the respective rates of acceleration and deceleration of the traverse motion speed (represented by the respective angles of ascent $\alpha$ and of descent $\beta$) remain constant throughout the package winding cycle. It is also noted that the rates of change in the length of traverse stroke (represented by the respective angles of decrease $\partial$ and of increase $\delta$) remain constant and equal throughout the package winding cycle. As illustrated in FIG. 1, the traverse motion speed is varied above a constant minimum traverse motion speed VSmin for the package winding cycle, but never exceeds a predetermined maximum speed VSmax. This arrangement is very advantageous in that it is technically easily achieved since the rates of acceleration and deceleration remain constant and, for pattern breaking, it is necessary to switch or change from acceleration to deceleration or vice versa at the starting and ending times of the period TK during which the length of traverse stroke is decreased. Since such times are preset by a sequence of numbers, which is preferably a random number sequence, both the traverse motion speed and traverse stroke are varied aperiodically. It should be noted that the rates of acceleration and deceleration of traverse motion speed, as well as the rate of stroke length change may be adjusted as to their absolute amounts for the package winding cycle, and it is only their relative values in association with each other that are controlled according to the method of this invention.

As illustrated in FIG. 1, the duration of the stroke modification cycles vary from one cycle to the other in accordance with the sequence of numbers, which determines either the duration of the period TK during which the stroke length is decreased or the amount $\Delta A$ of change in the length of stroke of each stroke modification cycle. In view of the limiting conditions for this process, namely TK=TL and TR=K×TB, the determination of foregoing factors will also determine the duration of the other periods of the stroke modification cycle.

At the beginning and end of each stroke length decreasing period TK, the traverse motion speed is switched or changed to its preset rate of acceleration or to its preset rate of deceleration. In this case, the rate of deceleration is precalculated so that at the end of each stroke modification cycle TA the traverse motion speed is equal to the predetermined minimum speed VSmin. Accordingly, in the illustrated form, $$\frac{\text{Acceleration}}{\text{Deceleration}} = 2K + 1,$$

and tan $\alpha$=2 tan $\beta$. In this form, an average traverse motion speed for the package winding cycle and thus the angle of yarn crossing can not be predetermined with any substantial degree of accuracy.

The embodiment of the present invention, illustrated in FIG. 1 and described above is entirely sufficient for many applications or uses. However, there are some applications or uses where it is highly desirable that the average traverse motion speed and thus the angle of yarn crossing be very accurately predetermined. In those instances, the embodiment of the present invention illustrated in FIG. 2 and now to be described permits such accurate predetermination while achieving pattern breaking and stroke modification. This is accomplished by predetermining an average traverse motion speed VSave (FIG. 2) and then during each period TK during which the length of stroke is being decreased, which is continuously changed from cycle to cycle, by accelerating the traverse motion speed in such a manner that a maximum traverse motion speed above the preset average value VSave is achieved during each stroke modification cycle TA. During this procedure, the rates of deceleration are continuously adapted to the respectively attained maximum traverse motion speed so that during each stroke modification and pattern breaking cycle, the maximum and minimum traverse motion speeds are symmetrical to the predetermined average traverse motion speed. This can be achieved in practical operation by presetting the rate of acceleration B and rate of deceleration V at a certain ratio for each stroke modification cycle whereby the formula (B/V)=2K+1 will apply.

Figure 2:
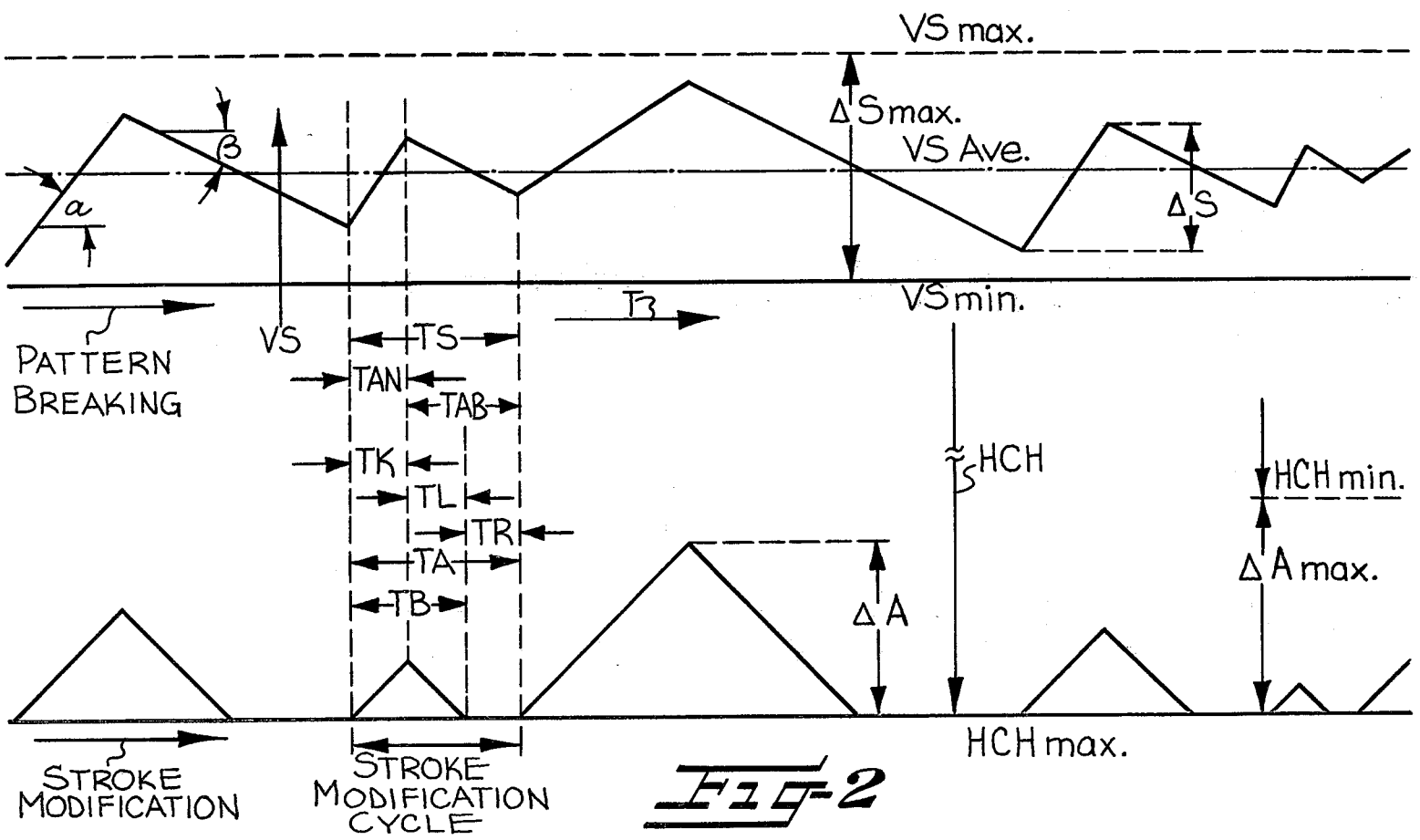
FIG. 2 is a schematic view similar to FIG. 1 illustrating the effects of traverse stroke modification and traverse speed change in accordance with another embodiment of the present invention.

As illustrated in FIG. 2, the duration of each stroke modification cycle TA is varied from the next cycle by changing the duration of the period TK or the amount of change in the length of traverse stroke $\Delta A$ according to a random number sequence preferably programmed into a memory. This results in amount of change in stroke length $\Delta A$ and the amount of change in traverse motion speed $\Delta S$ being proportionate to each other during each stroke modification and pattern breaking cycle.

At the beginning of each stroke modification and pattern breaking cycle, the traverse motion is accelerated at a rate so that, at the end of the stroke length decrease period TK and of the acceleration period TAN, the traverse motion speed will have reached a maximum speed for that cycle which is higher than the average traverse motion speed VSave which is at a constant presetting for the entire package winding cycle. Therefore, the rate of acceleration of the traverse motion for that cycle is dependent, on one hand, on the traverse motion speed that existed at the beginning of the cycle, and, on the other hand, on the duration of the period TK or acceleration period TAN. This rate of acceleration may be determined with a slight lead-in time before each cycle commences by a computer connected to the control means and which picks up the traverse motion speed at the beginning of the cycle and the duration of the acceleration period. However, it is technically simpler to calculate beforehand, for a sequence of numbers fed to a memory and which control the variable parameters of the stroke modification and pattern breaking cycles, the necessary rates of acceleration and to also feed those to a memory to be called with each number of the random sequence of numbers.

The rates of deceleration, represented by the angle $\beta$, are selected for each cycle so that the traverse motion will be decelerated during each deceleration period TAB to a minimum speed below the preset average traverse motion speed VSave by the same amount that the maximum speed achieved during the acceleration period exceeded the average speed. To achieve this, it is necessary to determine the rate of deceleration, represented by tan $\beta$, and this may be done by a computer from the formula $$\tan \beta = \frac{2\,(VSmax - VSave)}{TK\,(1 + 2K)}.$$

However, corresponding values may also be calculated beforehand and fed to a memory with the rates of acceleration.

Figure 3:
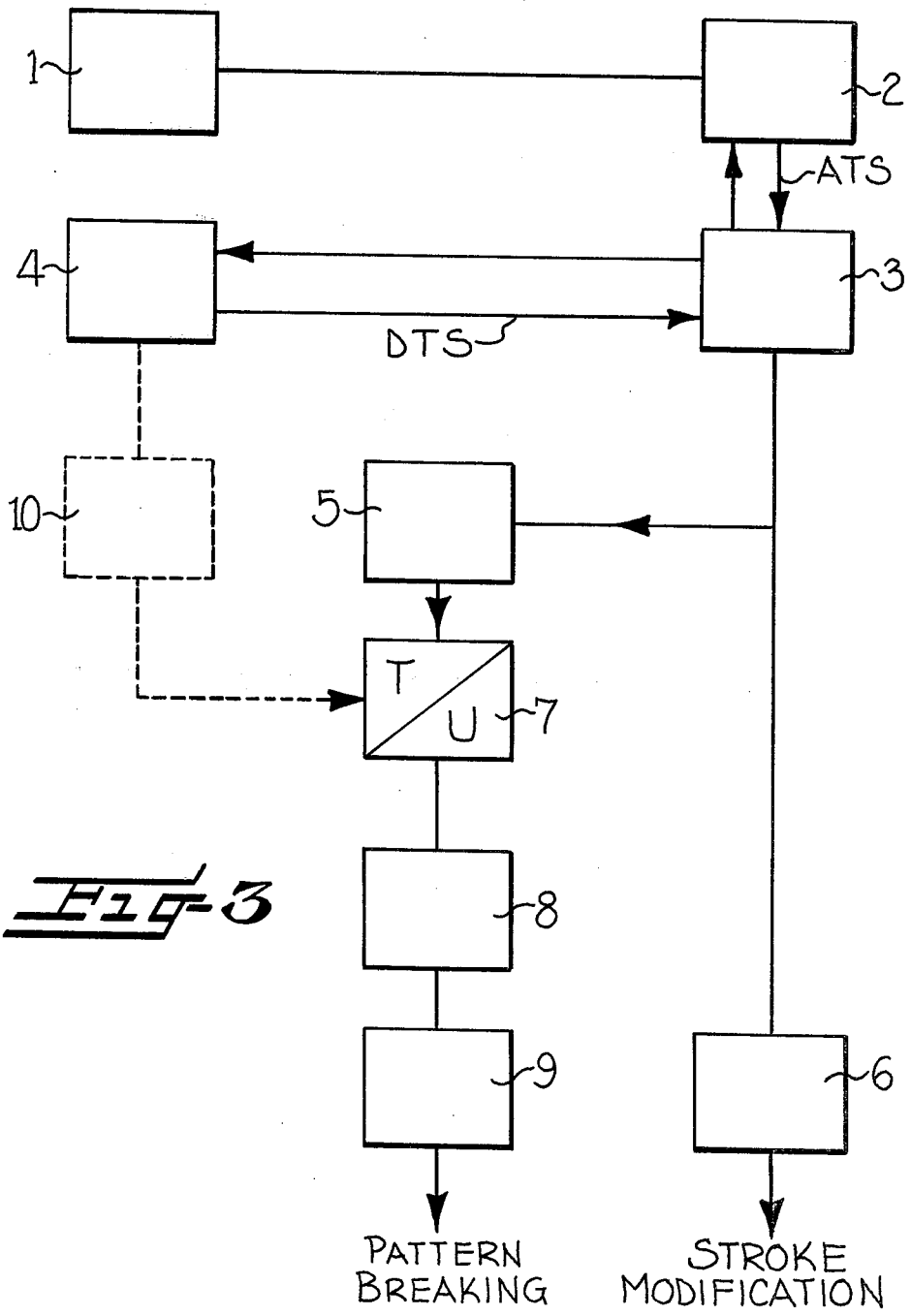
FIG. 3 is a schematic view of a control means for modifying the traverse stroke and for changing the traverse speed in accordance with the present invention.

Suitable control means for controlling the stroke modification and pattern breaking will readily occur to those skilled in the art from the foregoing description. One such control means is illustrated in FIG. 3 and includes a frequency transmitter 1 and counter 2 which produce an actual time signal ATS. This actual time signal ATS is supplied to a reverser 3 which also receives a desired time signal DTS from a time advance memory 4. If the desired time signal DTS corresponds with the actual time signal ATS, stroke modification control 6 first switches to stroke length decrease, then to stroke length increase, and finally to constant stroke length. The duration of stroke length decrease period TK, stroke length increase period TL and constant stroke length period TR may be directly stored in time advance memory 4. At the same time, reverser 3 supplies an output signal to a time signal transmitter 5 which is connected by way of a converter 7 to a pattern breaking control 8. Time signal transmitter 5 supplies a respectively positive or negative voltage signal to control 8 in response to the output signal from reverser 3. The range or amplitude of traverse motion speed change may be influenced by a supplementary control 9 if such is deemed necessary or desirable.

In this form, the control means may be employed for carrying out the embodiment of this invention as described based on the illustration of FIG. 1. To carry out the embodiment of FIG. 2, the control means should be supplemented by a memory 10 which converts the output signal from the converter 7 in such a manner that pattern breaking occurs with the precalculated rates of acceleration and deceleration.

In the drawings and specification there have been set forth preferred embodiments of the invention, and although specific terms are employed they are used in a generic and descriptive sense only and not for purposes of limitation.

What is claimed is:

1. In a method of winding textile yarns into core-supported packages in which the yarn is wound about the core at a substantially constant rate while the yarn is guided onto the core by a traversing yarn guide, the improvement therein comprising controlling the traverse of the yarn guide in a recurrent series of stroke modification cycles in each of which the length of the strokes of the yarn guide is progressively decreased at each end of the stroke up to a maximum differential range and progressively increased again at each end of the stroke up to a maximum constant stroke length during one portion of the cycle and is constant at that maximum stroke length during another portion of the cycle, and in which the maximum differential range by which the length of the strokes of the yarn guide is decreased is changed from one stroke modification cycle to another to prevent the formation of thickened and hardened places in the yarn package at opposite ends thereof.

2. A method according to claim 1 wherein the changes in the amount by which the length of the strokes of yarn guide is modified from one stroke modification cycle to another are made aperiodically.

3. A method according to claim 1 wherein the shortening of the length of the strokes of the yarn guide in each stroke modification cycle is made by gradually decreasing the length of the strokes until a minimum length of stroke, within said maximum differential range, for that cycle is reached and then by gradually increasing the length of the strokes until a maximum length of stroke is reached, and wherein the minimum length of stroke for each stroke modification cycle is different from the next cycle.

4. In a method of winding textile yarns into core-supported packages in which the yarn is wound about the core at a substantially constant rate while the yarn is guided onto the core by a traversing yarn guide, the improvement therein comprising controlling the traverse of the yarn guide in a recurrent series of stroke modification cycles in each of which the length of the strokes of the yarn guide is shortened at each end of the stroke, within a maximum differential range, during one portion of the cycle by gradually decreasing the length of each successive stroke until a predetermined minimum length of stroke is reached and then by gradually increasing the length of each successive stroke until a predetermined maximum length of stroke is reached, and in each of which the length of stroke is not shortened during the remainder of the cycle, and in which the amount by which the length of the strokes of the yarn guide is shortened is changed from one stroke modification cycle to another by varying aperiodically said predetermined minimum length of stroke to prevent the formation of thickened and hardened places in the yarn package at opposite ends thereof and to thereby provide a substantially cylindrical yarn package of uniform hardness.

5. A method according to claim 4 wherein the minimum length of stroke is varied from one stroke modification cycle to another by altering the rate at which the length of stroke is changed for a predetermined constant time period during the portion of each stroke modification cycle in which the length of stroke is shortened.

6. A method according to claim 4 wherein the minimum length of stroke is varied from one stroke modification cycle to another cycle by changing the duration of the time period during the portion of the stroke modification cycle in which the length of stroke is shortened while maintaining the rate of change of stroke length constant during this portion of each cycle.

7. A method according to claim 6 wherein the time period of each stroke modification cycle during which the length of stroke is being gradually decreased is equal to the time period of that stroke modification cycle during which the length of stroke is being gradually increased.

8. A method according to claim 7 wherein the time period of the portion of each stroke modification cycle in which the length of stroke is not shortened is proportional to the time period of the remainder of that stroke modification cycle in which the length of stroke is shortened and such proportion is kept constant throughout the package formation or winding cycle.

9. A method according to claim 8 in which the proportion of the duration of the portion of each stroke modification cycle in which the length of stroke is not shortened to the duration of the remainder of that stroke modification cycle is greater than 1:4 but less than 1:2.

10. In a method of winding textile yarns into core-supported packages in which the yarn is wound about the core at a substantially constant rate while the yarn is guided onto the core by a traversing yarn guide, the improvement therein comprising controlling the traverse of the yarn guide in a recurrent series of traverse stroke modification cycles, each of which is divided into two segments, the first segment comprising a period in which the length of traverse stroke is shortened at each end of the stroke, within a maximum differential range, by gradually decreasing the length of each successive stroke until a predetermined minimum length of stroke is reached and then by gradually increasing the length of each successive stroke until a predetermined maximum length of stroke is reached and the second segment comprising a period in which the length of stroke is not shortened from said predetermined maximum length, and changing the amount by which the length of the strokes of the yarn guide is shortened from one stroke modification cycle to another by varying aperiodically, in response to a random sequence, one of the variable parameters rate at which the length of stroke is changed or duration of the time period of said first segment of each stroke modification cycle to prevent the formation of thickened and hardened places in the yarn package at opposite ends thereof and to thereby provide a substantially cylindrical yarn package of uniform hardness.

11. In a method according to claim 10 wherein said random sequence is generated from a memory with a stored sequence of numbers.

12. In a method of winding textile yarns into core-supported packages in which the yarn is wound about the core at a substantially constant rate while the yarn is guided onto the core by a traversing yarn guide, the improvement therein comprising controlling the traverse of the yarn guide in a recurrent series of stroke modification and pattern breaking cycles in each of which the length of the strokes of the yarn guide is progressively decreased at each end of the stroke up to a maximum differential range and progressively increased again at each end of the stroke up to a maximum constant stroke length during one portion of the cycle and is constant at that maximum stroke length during another portion of the cycle, and in which the maximum differential range by which the length of the strokes of the yarn guide is decreased is changed from one stroke modification cycle to another to prevent the formation of thickened and hardened places in the yarn package at opposite ends thereof while the traverse motion speed of the yarn guide is varied by accelerating and decelerating the traversing yarn guide between predetermined maximum and minimum speeds to prevent undesirable pattern formation in the yarn windings in the package formed thereby.

13. A method according to claim 12 wherein the length of stroke in each stroke modification cycle is shortened by gradually decreasing the length of each successive stroke until a predetermined minimum length of stroke is reached and then by gradually increasing the length of each successive stroke until a predetermined maximum length of stroke is reached, and wherein the stroke modification and variance of the traverse motion speed are coordinated in such a manner that the periods of high traverse motion speed coincide with the periods of short traverse stroke length and vice versa.

14. A method according to claim 13 wherein the periods of acceleration of the traversing yarn guide are synchronized with the periods in which the length of stroke is being decreased and the periods of deceleration of the traversing yarn guide are synchronized with the periods in which the length of stroke is being increased and with the periods in which the length of stroke is not being modified.

15. A method according to claim 14 wherein the respective rates of acceleration and deceleration of the traversing yarn guide are constant throughout the package winding cycle with the traverse motion speed at the beginning and end of each stroke modification and pattern breaking cycle being equal to a constant predetermined minimum traverse motion speed.

16. A method according to claim 14 wherein the traverse motion speed is varied symmetrically above and below a predetermined constant average traverse motion speed during each stroke modification and pattern breaking cycle.

17. In an apparatus for winding textile yarns into core-supported packages including means for rotating the core to wind the yarn therearound at a substantially constant rate, yarn guide means movable axially of the core for guiding yarn onto the core, and means for traversing said yarn guide means, the improvement therein comprising control means operably connected to said traversing means for controlling the traverse of said yarn guide in a recurrent series of stroke modification cycles each of which has a first segment in which the length of the stroke of said yarn guide means is progressively decreased at each end of the stroke up to a maximum differential range and progressively increased again at each end of the stroke up to a maximum stroke length and a second segment in which the length of the stroke of said yarn guide means is constant at that maximum stroke length, said control means including means for altering the maximum differential range by which the length of the stroke of said yarn guide means is decreased from one traverse stroke modification cycle to another to prevent the formation of thickened and hardened places in the yarn packages at opposite ends thereof.

18. Apparatus according to claim 17 wherein said control means changes the length of stroke of said yarn guide means by shortening such length of stroke during said first segment of each stroke modification cycle to a predetermined minimum length of stroke for that cycle, and wherein said stroke altering means varies aperiodically the minimum length of stroke from one cycle to another.

19. Apparatus according to claim 18 wherein said control means shortens the length of stroke during said first segment of each cycle by gradually decreasing the length of successive strokes until said predetermined minimum is reached and then by gradually increasing the length of successive strokes until the original maximum length of stroke is reached and wherein said control means controls the traverse of said yarn guide means to provide a time duration for said second segment of each stroke modification cycle which is proportional to the time duration of said first segment thereof within a range greater than 1:4 but less than 1:2.

20. Apparatus according to any of claims 17 through 19 wherein said stroke altering means alters the amount by which the length of stroke is changed by varying aperiodically, in response to a random sequence, one of the variable parameters of rate at which the length of stroke is changed or time duration of said first segment of the stroke modification cycle from one cycle to another.

21. In an apparatus for winding textile yarns into core-supported packages including means for rotating the core to wind the yarn therearound at a substantially constant rate, yarn guide means movable axially of the core for guiding yarn onto the core, and means for traversing said yarn guide means, the improvement therein comprising control means operably connected to said traversing means for controlling the traverse of said yarn guide in a recurrent series of stroke modification cycles each of which has a first segment of the cycle in which the length of the stroke of said yarn guide means is progressively decreased at each end of the stroke up to a maximum differential range and progressively increased again at each end of the stroke up to a maximum stroke length and a second segment of the cycle in which the length of the stroke of said yarn guide means is constant at that maximum stroke length, said control means including means for altering the maximum differential range by which the length of the stroke of said yarn guide means is decreased from one traverse stroke modification cycle to another to prevent the formation of thickened and hardened places in the yarn packages at opposite ends thereof and means for continuously changing the traverse motion speed of said yarn guide means by accelerating and decelerating said traversing yarn guide means between predetermined maximum and minimum speeds to prevent undesirable pattern formation in the yarn windings in the package formed thereby.

22. Apparatus according to claim 21 wherein said control means shortens the length of stroke in each stroke modification cycle by gradually decreasing the length of each successive stroke until a predetermined minimum length of stroke is reached and then by gradually increasing the length of each successive stroke until a predetermined maximum length of stroke is reached, and wherein said stroke altering means and said traverse speed changing means coordinates the stroke modification cycles and the traverse motion speed change sequence in such a manner that the periods of high traverse motion speed coincide with the periods of short traverse stroke length and vice versa.

23. Apparatus according to claim 22 wherein said stroke altering means and said traverse speed changing means synchronizes the periods of acceleration of said traversing yarn guide means with the periods in which the length of stroke is being decreased and the periods of deceleration of said traversing yarn guide means with the periods in which the length of stroke is being increased and with the periods in which the length of stroke is not being changed.

24. Apparatus according to claim 23 wherein said traverse speed changing means accelerates and decelerates the traverse of said yarn guide means at substantially respective constant rates throughout the package winding cycle and with the traverse motion speed at the beginning and end of each stroke modification and pattern breaking cycle being equal to a constant predetermined minimum traverse motion speed.

25. Apparatus according to claim 23 wherein said traverse speed changing means varies the traverse motion speed symmetrically above and below a predetermined constant average traverse motion speed during each stroke modification and pattern breaking cycle.

26. In a method of winding textile yarns into core-supported packages in which the yarn is wound about the core at a substantially constant rate while the yarn is guided onto the core by a traversing yarn guide, the improvement therein comprising controlling the traverse of the yarn guide in a recurrent series of stroke modification cycles in each of which the length of the strokes of the yarn guide is progressively decreased at each end of the stroke up to a maximum differential range and progressively increased again at each end of the stroke up to a maximum constant stroke length during one portion of the cycle and is constant at that maximum stroke length during another portion of the cycle, and in which the maximum amount by which the length of the strokes of the yarn guide is decreased in one stroke modification cycle is changed in another stroke modification cycle to prevent the formation of thickened and hardened places in the yarn package at opposite ends thereof.

27. In a method of winding textile yarns into core-supported packages in which the yarn is wound about the core at a substantially constant rate while the yarn is guided onto the core by a traversing yarn guide, the improvement therein comprising controlling the traverse of the yarn guide in a recurrent series of stroke modification and pattern breaking cycles in each of which the length of the strokes of the yarn guide is progressively decreased at each end of the stroke up to a maximum differential range and progressively increased again at each end of the stroke up to a maximum constant stroke length during one portion of the cycle and is constant at that maximum stroke length during another portion of the cycle, and in which the maximum amount by which the length of the strokes of the yarn guide is decreased in one stroke modification cycle is changed in another stroke modification cycle to prevent the formation of thickened and hardened places in the yarn package at opposite ends thereof while the traverse motion speed of the yarn guide is varied by accelerating and decelerating the traversing yarn guide between predetermined maximum and minimum speeds to prevent undesirable pattern formation in the yarn windings in the package formed thereby.

* * * * *

UNITED STATES PATENT AND TRADEMARK OFFICE

CERTIFICATE OF CORRECTION

PATENT NO. : 4,325,517

DATED : April 20, 1982

INVENTOR(S) : Heinz Schippers, et al.

It is certified that error appears in the above-identified patent and that said Letters Patent are hereby corrected as shown below:

Column 1, line 21, "∓" should be --"--.

Column 3, line 25 "AT" should be --TA--.

Column 9, line 14, after "parameters" insert --of--.

Signed and Sealed this

Twenty-first Day of December 1982

[SEAL]

*Attest:*

GERALD J. MOSSINGHOFF

*Attesting Officer*

*Commissioner of Patents and Trademarks*